US011241693B2

(12) United States Patent
Robles Opazo et al.

(10) Patent No.: US 11,241,693 B2
(45) Date of Patent: Feb. 8, 2022

(54) SYSTEM FOR IN-LINE ESTIMATION OF LOAD DISTRIBUTION IN A ROTARY MILL

(71) Applicants: NETOS S.A., Valparaiso (CL); UNIVERSIDAD TECNICA FEDERICO SANTA MARIA, Valparaiso (CL)

(72) Inventors: Hernan Ariel Robles Opazo, Valparaiso (CL); Tania Alejandra Ledezma Torres, Valparaiso (CL); Javier Alberto Inostroza Inostroza, Valparaiso (CL); Jorge Antonio Pontt Olivares, Valparaiso (CL); Waldo Marcelo Valderrama Reyes, Valparaiso (CL); Juan Yianatos Bernardino, Valparaiso (CL); Luis Eduardo Vinnett Peralta, Valparaiso (CL)

(73) Assignees: Netos S.A., Valparaiso (CL); Universidad Tecnica Federico Santa Maria, Valparaiso (CL)

( * ) Notice: Subject to any disclaimer, the term of this patent is extended or adjusted under 35 U.S.C. 154(b) by 938 days.

(21) Appl. No.: 15/572,318

(22) PCT Filed: May 6, 2016

(86) PCT No.: PCT/CL2016/000021
§ 371 (c)(1),
(2) Date: Jan. 23, 2018

(87) PCT Pub. No.: WO2016/176788
PCT Pub. Date: Nov. 10, 2016

(65) Prior Publication Data

US 2018/0126384 A1 May 10, 2018

(30) Foreign Application Priority Data

May 7, 2015 (CL) ..... 1220-2015

(51) Int. Cl.
*B02C 17/18* (2006.01)
*B02C 25/00* (2006.01)

(52) U.S. Cl.
CPC ..... *B02C 17/1805* (2013.01); *B02C 25/00* (2013.01)

(58) Field of Classification Search
CPC ..... B02C 17/1805; B02C 25/00
See application file for complete search history.

(56) References Cited

U.S. PATENT DOCUMENTS 5,698,797 A 12/1997 Fontanille et al.
6,874,364 B1 * 4/2005 Campbell ..... G01H 3/12 73/593

(Continued)

FOREIGN PATENT DOCUMENTS

CA 2378570 A1 1/2001

OTHER PUBLICATIONS

Araya Lara, Hugo Boris; International Search Report and Written Opinion of the International Searching Authority, issued in International Application No. PCT/CL2016/000021; dated Sep. 6, 2016; 14 pages.

(Continued)

*Primary Examiner* — Regis J Betsch
*Assistant Examiner* — Jeremy A Delozier
(74) *Attorney, Agent, or Firm* — Ulmer & Berne LLP

(57) ABSTRACT

A system and method for online estimate of the filling level of balls and loading level in a rotary mills, comprising a set of vibration sensors unit, associated with a magnet to transmit data signals via an antenna to a receiver that receives data signals from the antenna, an antenna, wherein the receiver is connected via optical fiber to a signal processor, which in turn communicates to a control server via a UTP cable, wherein the control server also obtains data (Continued)

from the mill operation to determine the best filling of balls and load; and the operating method.

9 Claims, 5 Drawing Sheets

(56) References Cited

U.S. PATENT DOCUMENTS

| | | | | |
|---|---|---|---|---|
| 6,874,366 | B2 | 4/2005 | Magne Ortega et al. | |
| 2004/0255680 | A1* | 12/2004 | Ortega | B02C 17/1805 73/649 |
| 2008/0097723 | A1* | 4/2008 | Pontt Olivares | B02C 17/1805 702/182 |
| 2014/0150524 | A1 | 6/2014 | Magne et al. | |

OTHER PUBLICATIONS

Spencer, S.J.; Acoustic Emissions Monitoring of SAG Mill Performance; Proceedings of the Second International Conference on Intelligent Processing and Manufacturing of Materials; Jul. 10-15, 1999; 8 pages.

Huang, P. et al.; A Study on the Technique of Measuring the Fill Level Based on the Vibration Signal of the Ball Mill Shell; 2009 WRI World Congress on Computer Science and Information Engineering; Mar. 31-Apr. 2, 2009; pp. 202-206.

Sagmilling.com; Morrell C-model, developed as part of PhD thesis of Stephen Morrell, University of Queensland retrieved from https://wiki.sagmilling.com/index.php/Morrell_C-Model on Apr. 3, 2018; page last modified on Jun. 18, 2016; 2 pages.

* cited by examiner

SYSTEM FOR IN-LINE ESTIMATION OF LOAD DISTRIBUTION IN A ROTARY MILL

FIELD OF APPLICATION

The present invention refers to the control of operation of rotary mills in the mining industry, more specifically an electronic system and method for the on-line estimate of the balls filling level and the loading level in a rotary mill.

DESCRIPTION OF THE PRIOR ART

Grinding is the last step of the comminution process. In this step, the size of the ore particles is reduced through a combination of impact and abrasion, whether dry or moist. The equipment mostly used at industrial level for milling is the horizontal rotary mills.

There are different types of rotary mills, such as rod, ball, autogenous (AG) and semiautogenous (SAG). All of them characterize for a tumbling action allowing the comminution of the material. Structurally, each type of mill consists of a cylindrical shell provided with renewable liners and a load of grinding media. The length and diameter of the mill determine the volume and, therefore, the capacity of the equipment. All types of mill can be used for wet or dry miffing by modifying the feeding and discharge areas.

SAG grinding circuits are constituted by a primary crushing step, followed by a SAG mill commonly associated with a stone crusher (pebbles) and then a ball mill. These circuits are those mostly used today because of the advantages they have compared to conventional grinding circuits, which were constituted by three stages of crushing, followed by a rod mill and a ball mill.

While global energy consumption in [kWh/ton] of product is comparable for both systems, tending to be a little higher for SAG systems, experience has shown that a line incorporating the SAG grinding will require a lower capital cost than the traditional line. There is also a decrease in maintenance cost due to the elimination of secondary and tertiary crushing stages.

SAG mill operation involves reducing the consumption of grinding media, compared with the costs associated with the consumption of balls and rods in a conventional circuit which also have a higher wear of coatings.

SAG mills are large-capacity equipment developed before the need to process larger flows due to lower grades of valuable minerals. Currently, there are SAG mills up to 12.19 [m] diameter and 20 [MWh] power in operation, where economies of scale can be used. SAG mills are more efficient than rod mills, in which there has been no success in increasing its size beyond 6.71 [m] long, because of excessive breakage and locking of bars when increasing its length.

The load inside a mill is usually called kidney, due to the characteristic form taken by it when the equipment is in motion. In the behavior of the kidney in a mill rotating counter clockwise, where the load rises on the right side to a point where it falls again, this point is known as the load shoulder. At the bottom, the load foot is located, which characterizes for a chaotic movement of the landing load, which dissipates the remaining energy of the fall to be raised again.

Two regimes of fall are defined, which will depend on the particle position and the mill's speed of operation, one known as cataract for free fall and another one as cascade for collapsing on other bodies.

To prevent slippage of the load, which would imply an inefficient use of energy, the mill shell has an inner liner provided with projections (lifters) and depressions (plaques). The profile of this liner highly influences the movement of the load and the path of falling particles. In addition, in conjunction with the viscosity of the pulp in the mill, the liner profiles can have a substantial effect on the actual critical speed.

Generally, the models of power consumption for mills do not include the effect of lifting bars design, although some designs have proven to give a greater cataract effect than others at the same fraction of critical speed and filling level. Therefore, they should give maximum power at different values of filling and speed.

Considering the behavior of power consumption in rotary mills, it can be concluded that this equipment should be operated at filling values and critical speed dose to maximum power consumption, as this determines the maximum production capacity of the mill.

The filling level in a mill corresponds to the useful internal volume of the equipment being occupied by the load, consisting of balls, mineral and water. Keeping the proper level of charge in the mill is one of the most important elements for efficient grinding. During the operation, you must ensure that the liners are protected from the direct impact of the balls. This is achieved by maintaining an optimum level of loading, supplemented by a control of speed that allows the point of impact being produced at the foot of the load, benefiting the grinding action, as both a low load and overload will harm the process of grinding.

The parameters most commonly used to describe the filling level are those corresponding to the load level and the level of grinding media (balls). Both parameters are calculated as the ratio of the volume used by the load bed or ball bed, and the available volume of the mill, taking into account the porosity of the bed.

Anglo American Chile at El Soldado mine describes a development of 2014 by Nelson Iglesias, Francisco Vicuna and Miguel Becerra, for estimating the level of total load filling (Jc) using a C-Model of Morrell (Morrell. 1993) to estimate the power of a SAG mill, which is calibrated by the laser scanning technology called FARO, where the measuring of load and balls of the filling levels is carried out by stopping the grinding being performed. The C-Model is essentially a balance of friction between concentric layers within the rising part of the mill load.

The patent of invention U.S. Pat. No. 6,874,364 B1, dated 5 Apr. 2005, entitled "System for monitoring mechanical waves from a moving machine", Cambell et al, discloses a system for monitoring the mechanical waves of a machine, which during its operation moves the material therein; the system includes at least one sensor on the machine in a location away from the central axis of the machine, the sensors detect acoustic waves and include a transmitter for transmitting signals representing the mechanical waves detected to a receiver at a remote location from the sensor(s), a data processor connected to the receiver for receiving signals from the signal receiver representing the mechanical waves and processing the signals to produce output signals for display on a screen, wherein the output signals for display represent one or more parameters indicating mechanical waves emitted from the machine during a predetermined time.

The patent of invention U.S. Pat. No. 6,874,366 82 dated May 4, 2005 entitled "System to determine and analyze the dynamic internal load in revolving mills, for mineral grinding", Pontt et al, describes in a dynamic way a direct system and method and online measurement of various parameters related to the volume occupied by the internal dynamic loading of rotating mills when being in operation, specifically an online measurement of the total filling of volume dynamic load, the dynamic volume load of balls, dynamic volume mineral filling and the bulk density of the internal load of the mill. The present invention comprises a number of wireless acoustic sensors connected to the outer body of the mill, a receiver and/or conditioning unit situated near the mill, a processing unit and a communication unit.

The patent of invention U.S. Pat. No. 5,698,797 patent, dated 16 Dec. 1997, entitled "Device for monitoring a ball grinder", Fontanille et al, describes a device for controlling a ball mill having a cylindrical casing containing a mass of balls, which, when the mill is rotating at its nominal speed, takes up a position between two generatrices (1b, 1b') separated by an angle between a minimum alpha min angle and a maximum alpha max angle and a mass of coal, which, when the mill rotates at its nominal speed, occupies a position between two generatrices (1c, 1c') separated by a beta angle. An emitter of electromagnetic waves is arranged inside the mill and at least one receiver is arranged outside the mill. The receiver is associated with an electronic circuit to determine at least one parameter of the mill selected from the amount of balls, the amount of coal and the cylinder wear.

No other evidence has been found referring to the operation control of rotary mills in the mining industry, more specifically to an electronic system and method for the online estimate of the balls filling level and the load level in a rotary mill, by sensing the vibrations that occur inside the mill.

SUMMARY OF THE INVENTION

In a first object of the invention, a system for online estimate of the filling level of balls and load level in a rotary mill is proposed, comprising a set of vibration sensors unit, associated with a magnet, which transmits signals of data via an antenna to a receiver that receives data signals from the antenna, where the receiver is connected by optical fiber to a signal processor which in turn communicates to a control server via a UTP cable, wherein the server also obtains operation data from the mill to determine the filling of balls and load; in addition, a second object of the invention is proposed, as well as a method for the online estimate of the filling level of balls and load level in a rotary mill comprising as follows: obtaining the operational data of a mill and the data from a signal processor; where data of the mill operation correspond to input grain size distribution of fresh ore, tonnage of fresh ore, water supply; rotation speed of the mill, recharge of balls, average power and pressure on the mill bearings, among the most relevant; and wherein the data from signal processor correspond to the average and variance of the mill vibrations, which were obtained by a first processor; calculate the instantaneous power p(t) consumed by the mill and determine the foot and shoulder of the mill load; assess models of foot, shoulder, power, pressure, wear and tear of liners and wear of ball; iterate the values of balls filling and load filling in the mentioned models; and compare the prediction from models with values measured throughout the system, and the values obtained from the mill operation, to achieve a minimum error in the set of variables.

DESCRIPTION OF A PREFERRED EMBODIMENT

Figure 1:
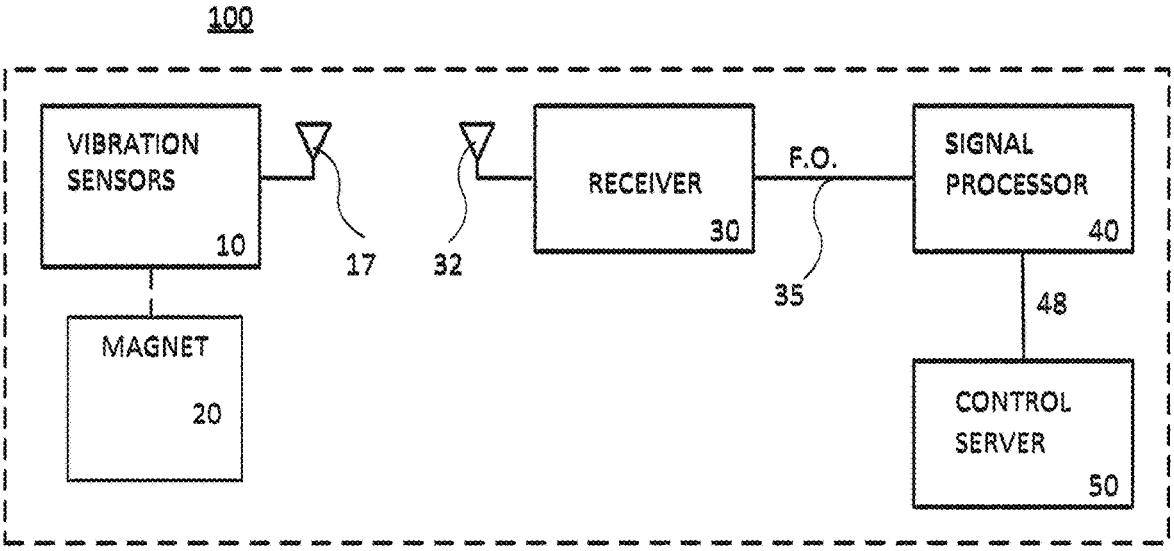
FIG. 1 depicts a block diagram of the electronic system of the invention.
Figure 2:
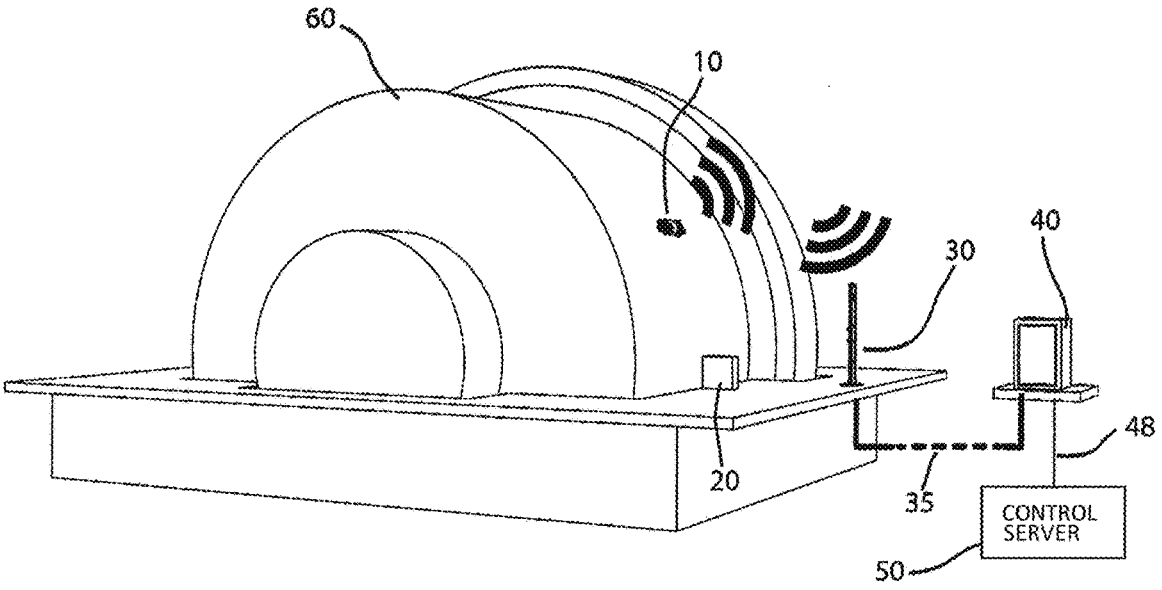
FIG. 2 depicts an isometric view of the electronic system of the invention configured in a mill.
Figure 5:
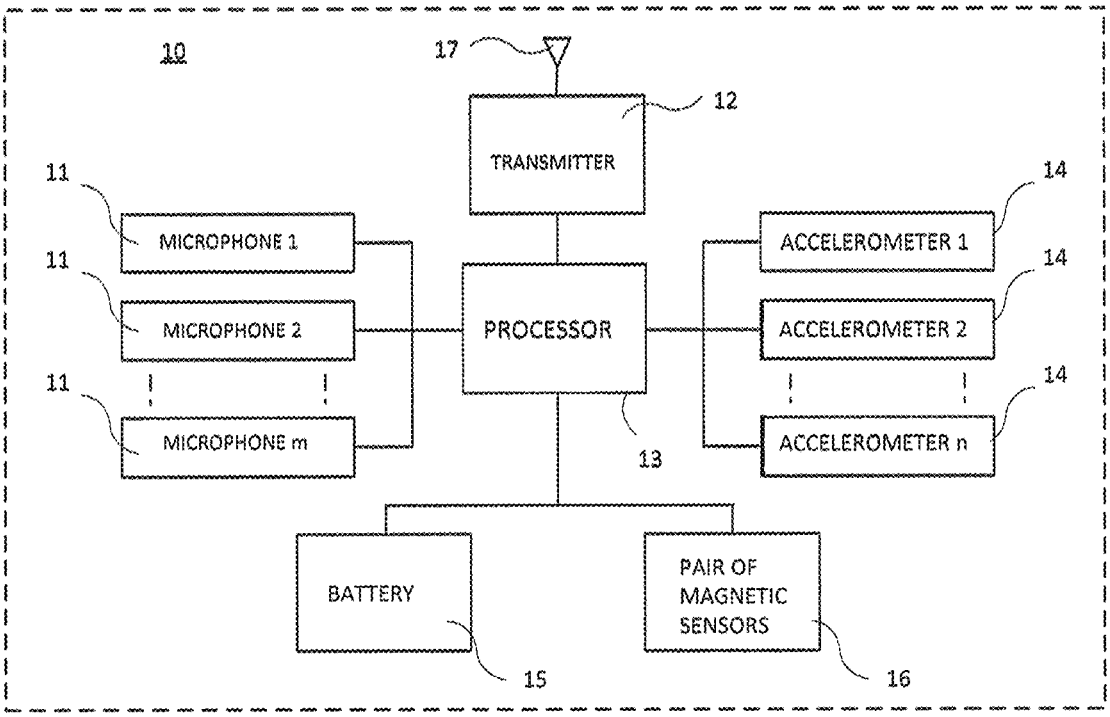
FIG. 5 depicts the block diagram of the scanner of vibrations.

The present invention relates to a system and method for online estimate of the filling level of balls (62) and loading level (63) in a rotary mill. FIG. 1 describes an electronic system (100) comprising a set of vibration sensors unit (10), associated with a magnet (20) to transmit data signals via an antenna (17) to a receiver (30) that receives data signals from the antenna (17), an antenna (32), wherein the receiver (30) is connected via optical fiber (35) to a signal processor (40), which in turn communicates to a control server (50) via a UTP cable (48), wherein the control server (50) also obtains data from the mill operation to determine the best filling of balls (62) and load (63). As shown in FIG. 2, the system (100) is installed in the environment of a rotary mill (60), wherein the set of vibration sensors unit (10) comprises at least two vibration sensors (10, 10') which are placed on the mantle of the mill (60), equidistant at least at an angle greater than 90°, so that the data signal transmitted through the antenna (17) is only received by the antenna (32) of the receiver (30) from only one of the vibration sensors (10, 10') during the transmission interval; the magnet (20) located on one side and close to the mantle of the mill (60), allows vibration sensors (10, 10') passing periodically by the magnet (20) to detect the direction and speed of rotation, allowing to determine the angle for wireless transmission to the receiver (30). FIG. 5 details the structure of the set of vibration sensors unit (10), which comprises a pair of magnetic sensors (16) to detect the direction and speed of rotation, providing this information to a first processor (13) as a sync signal, which also receives a signal of the state of charge of a battery (15), which feeds the set of vibration sensors unit (10); a plurality of microphones (11), connected to the first processor (13) receive sounds from the inside of the mill (60) for abnormal noise analysis; a plurality of accelerometers (14) connected to the first processor (13) register the vibrations produced by the load (63) during the grinding process; all information received by the first processor (13) is processed and sent by a transmitter (12) to the receiver (30), located near the mill (60), so as to receive a single data stream only from one of the vibration sensors (10, 101 each time.

Figure 6:
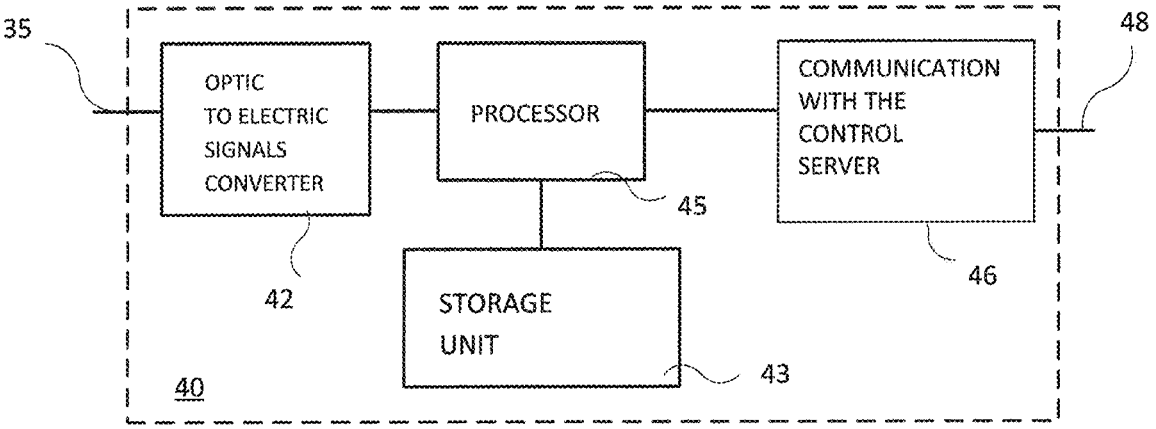
FIG. 6 depicts the block diagram of the signal processor.

As shown in FIG. 6, the receiver (30) sends the information to the signal processor (40) through optical fiber (35), wherein a converter of optical signals to electrical signals (42) sends electrical signals to a second processor (45) that directs them through the communication unit (46) to the control server (50) through the UTP cable (48); data are periodically sent to the control server (50), to which effect they are previously stored in a storage unit (43), when received by the converter of optical signals to electrical ones (42).

Figure 3:
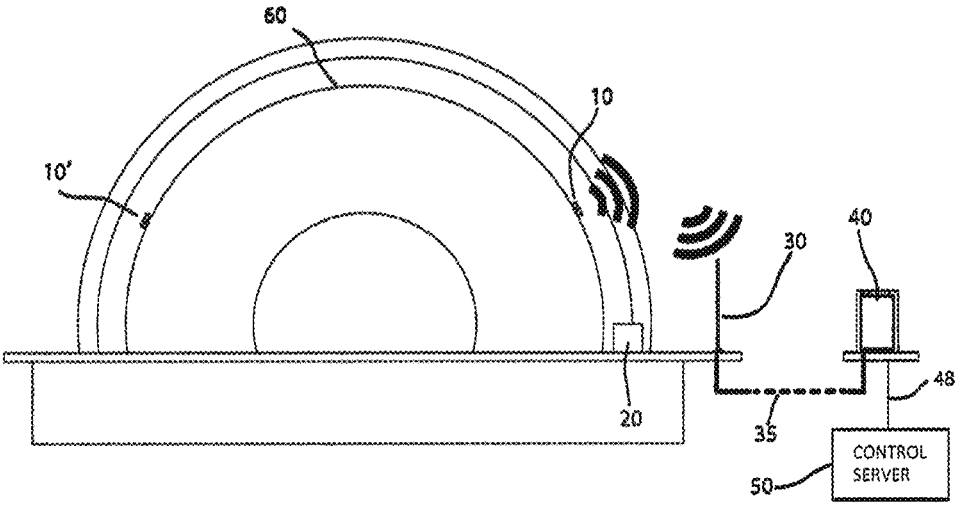
FIG. 3 depicts a side view of the electronic system of the invention configured in a mill.

FIG. 3 shows a side view of the mill (60), where, for example, two vibration sensors (10, 10') can be seen on the mantle separated in such a way, that only one of them can transmit to the receiver (30), wherein said transmission is controlled by the first processor (13) which sends a signal to the battery (15) to feed the transmitter (12) only during the transmission interval that each of the vibration sensors (10, 10') has.

Figure 4:
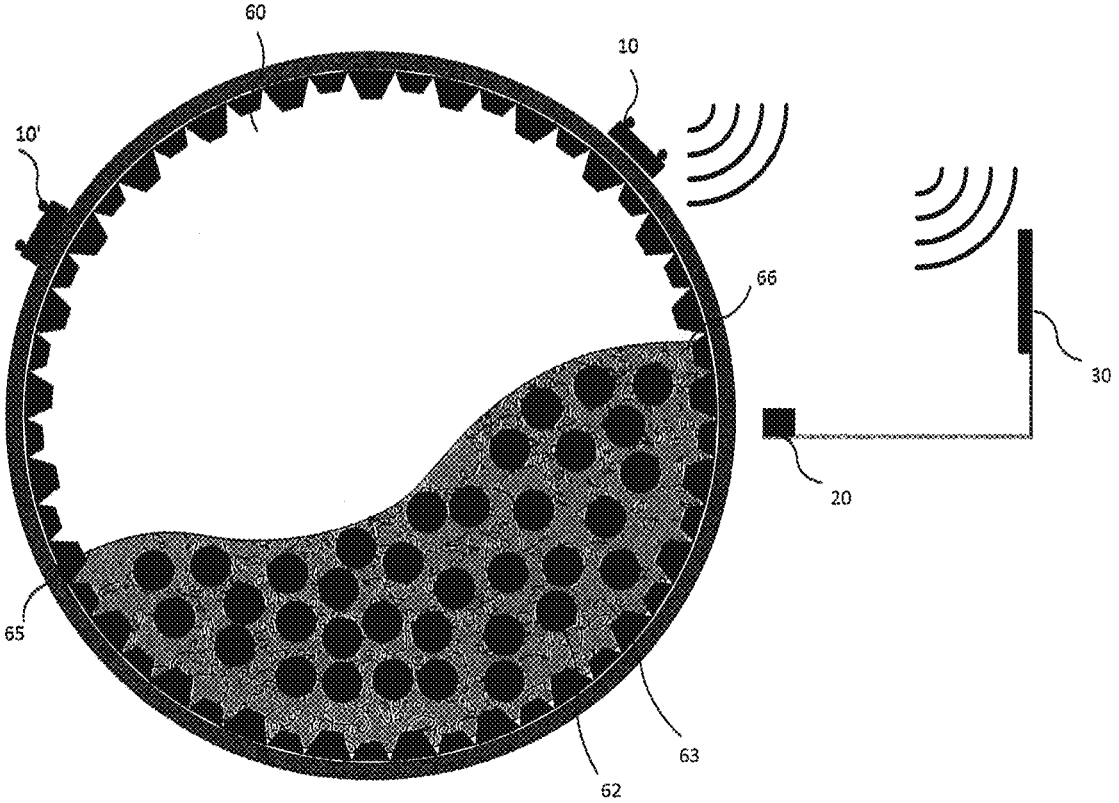
FIG. 4 depicts a side sectional view of the electronic system of the invention configured in a mill.

FIG. 4 discloses a sectional view of the mill (60), which shows inside a load (63) and a ball load (62), forming a volume which has a shoulder (66) and a foot (65).

The set of vibration sensor unit (10) processes the information received from the plurality of accelerometers (14) in the first processor (13); the accelerometers (14) have different ranges of operation, so that when there is saturation in any of them, the information is valid in at least one of them, in the understanding that the operating ranges cover the entire spectrum of vibrations produced by the mill (60) during operation.

The first processor (13) collects the information from the accelerometers (14) for a number of turns preset and processes this information covering the entire circumference of the mantle of the mill (60) and sends all values during the interval of time available for each sensor of vibrations (10, 10'); the values obtained allow determining the shoulder (66) and foot (65) of the volume of load in the control server (50).

The data obtained by the accelerometers (14) that are processed by the first processor (13), together with those of sound obtained by microphones (11), and the synchronizing signal for a predetermined amount of turns allows the first processor (13) determining the direction of rotation, the quadrant where the foot (65) should be located and the quadrant where the shoulder (66) should be located. With sound intensity it is verified that the quadrants are the right ones. Then, the average of amplitude and variance of vibrations are calculated for the entire circumference of the mill (60) and for each turn. Then an average between turns is obtained, getting an average and a variance of a turn that represents them all. Subsequently, the line considered with the receiver (30) is awaited and in the transmission time defined before the results obtained are sent along with the possible quadrants for foot (65) and shoulder (66).

Figure 7:
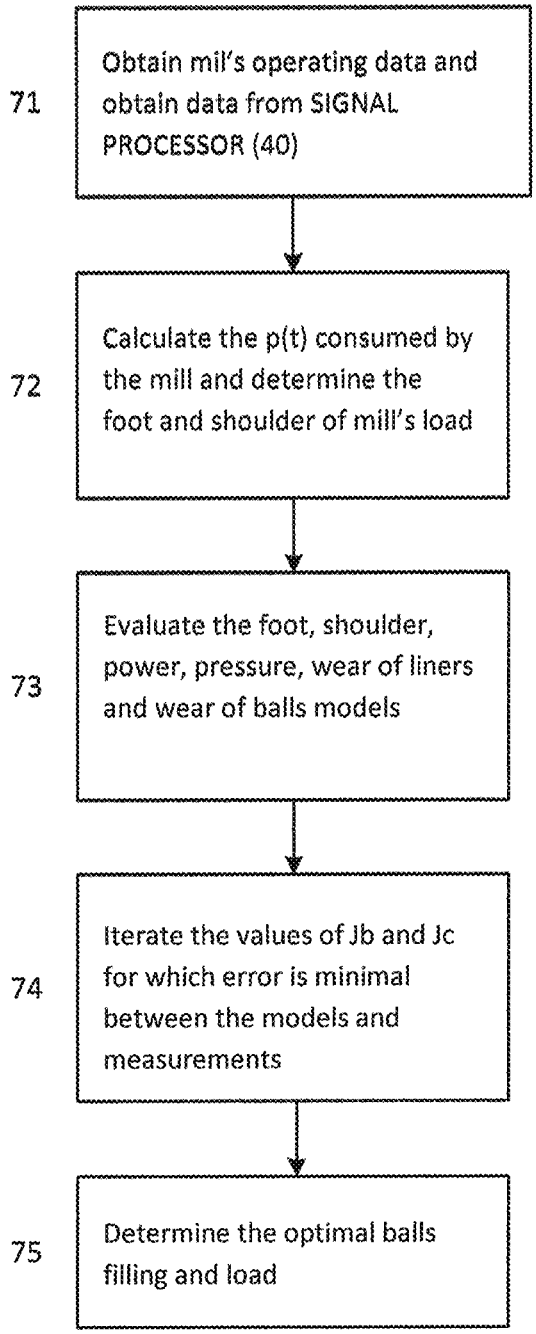
FIG. 7 depicts a flow chart of the operating method of the system.

The operating method shown in FIG. 7, describes a first stage (71) to obtain the mill operating data (60) and to obtain data from the signal processor (40); wherein the mill operating data (60) correspond to input grain size distribution of fresh ore, tonnage of fresh ore, water supply, rotation speed of the mill (60), refill of balls (62), average power and pressure on the mill (60) bearings, among the most relevant; and wherein the data from the signal processor (40) correspond to the average and variance, which were obtained by a first processor (13).

Step (72) allows the calculation of the instantaneous power p(t) consumed by the mill (60) and determining the foot (65) and shoulder (66) of the load (63) of the mill (60); wherein in order to determine the foot (65), first a first order filter is performed to remove noise, the variance maximum values are sought within the applicable radial quadrant and finally the radial location of most energy is determined, which corresponds to the foot (65) of the total load.

To determine the shoulder (66), first a first order filter is performed to remove noise, the maximum values of reverse variance are sought within the applicable radial quadrant and finally the radial location of most energy is determined, which will correspond to the shoulder (66) of the total load.

Step (73) allows assessing the models of foot (65), shoulder (66), power, pressure, and wear of liners and of balls (62). The models of foot (65) and shoulder (66) correspond to models defined by parametric equations, for example, those described by Morrell, where an angle of foot (65) and shoulder (66) is obtained as a function of loading (63) and balls (62) filling. The model of power available in the state of art and also described by Morrell allows obtaining the power consumed by the mill (60) depending on the filling of loading (63) and balls (62). The model of pressure on the bearings of mill (60) corresponds to linearization of the statistical behavior during the years of operation of the mill (60) where a pressure that depends on the filling of load (63) and balls (62) is obtained. The model of liner wear corresponds to linearization of the statistical behavior during the years of operation of the mill (60) where the actual lining wear during operation is measured and average wear is obtained. The model of balls (62) wear corresponds to linearization of the statistical behavior of consumption of balls (62) over the years considering the sizes of input and output sizes of the balls (62), thereby calculating the wear average.

Step (74) allows iterating the filling values of balls (62) and load (63) within the aforementioned models, and comparing the prediction of models with the values measured by the system and the values obtained from the operation of the mill (60) until achieving a minimum error in the set of variables.

Finally, the step (75) allows obtaining the optimal values for the filling of balls (62) and filling of load (63) for which the overall error is minimal.

The invention claimed is:

1. A system for online estimate of the filling level of balls and loading level in a rotary mill, the system comprising:

a signal processor (40) connected to a receiver (30) via optical fiber (35) and an antenna (32) located outside and near said mill (60);

a magnet (20) located outside and near said mill (60);

a set of vibration sensors unit (10) placed on the mantle of said mill (60), comprising a first processor (13), an antenna (17), a plurality of accelerometers (14) and a plurality of microphones (11), all connected to said first processor (13), wherein said first processor (13) is configured to:

register the vibrations produced by the load (63) during the grinding process and measure the sounds from inside the mill (60) by said plurality of microphones (11);

produce data corresponding to the average and variance of vibrations of the mill (60);

obtain a synchronism signal by the obtained sound;

determine the direction of rotation and the quadrant where it should be located the foot (65), and the quadrant where it should be located the shoulder (66) of the load; and transmit data signals by said antenna (17) to said receptor (30) by said antenna (32) and said signal processor (40) is configured to receive said data signals and obtain said data corresponding to the average and variance of vibrations of the mill (60), said synchronism signal and of foot quadrant and shoulder quadrant;

a control server (50) configured to communicate with said signal processor (40) via a UTP cable (48), and configured to:

obtain data from the operation of the mill (60) as input grain size distribution of fresh ore, tonnage of fresh ore, water supply, rotation speed of the mill (60), refill of ball (62), average power and pressure on the mill (60) bearings;

calculate the instantaneous power p(t) consumed by the mill (60) and determining the foot (65) and shoulder (66) of the load (63) of the mill (60);

assess the models of foot (65), shoulder (66), power, pressure, wear of liners and of balls (62);

iterate the filling values of balls (62) and load (63) within the aforementioned models, and compare the prediction of models with the values measured in the data signals by the system; and determine the level of filling of balls (62) and level of load (63) based on said comparison.

2. The system according to claim 1, wherein the system is installed in the environment of a rotary mill (60); where the set of vibration sensors unit (10) comprises at least two vibration sensors (10, 10') which are placed on the mantle of the mill (60), equidistant at least at an angle greater than 90°, so that the data signal transmitted through the antenna (17) is only received by the antenna (32) of the receiver (30) from only one of the vibration sensors (10, 10') during the transmission interval; the magnet (20) located on one side and close to the mantle of the mill (60), allows vibration sensors (10, 10') passing periodically by the magnet (20) to detect the direction and speed of rotation, allowing to determine the angle for wireless transmission to the receiver (30).

3. The system according to claim 2, wherein the set of vibration sensors unit (10) comprises a pair of magnetic sensors (16) to detect the direction and speed of rotation; providing this information to the first processor (13) as the synchronism signal, which also receives a signal of the state of charge of a battery (15), which feeds the set of vibration sensors unit (10); the plurality of microphones (11), connected to the first processor (13) receive sounds from the inside of the mill (60) for abnormal noise analysis; the plurality of accelerometers (14) connected to the first processor (13) register the vibrations produced by the load (63) during the grinding process; all information received by the first processor (13) is processed and sent by a transmitter (12) to the receiver (30), located near the mill (60), so as to receive a single data stream only from one of the vibration sensors (10, 10'), each time.

4. The system according to claim 1, wherein the receiver (30) sends the information to the signal processor (40) through optical fiber (35), where a converter of optical signals to electrical signals (42) sends electrical signals to a second processor (45) that directs them through the communication unit (46) to the control server (50) through the UTP cable (48), data are periodically sent to the control server (50), to which effect they are previously stored in a storage unit (43), when received by the converter of optical signals to electrical ones (42).

5. The system according to claim 2, wherein the two vibration sensors (10, 10') are separated in such a way, that only one of them can transmit to the receiver (30), where said transmission is controlled by the first processor (13) which sends a signal to the battery (15) to feed the transmitter (12) only during the transmission interval that each of the vibration sensors (10, 10') has.

6. The system according to claim 3, wherein the accelerometers (14) have different ranges of operation, so that when there is saturation in any of them, the information is valid in at least one of them, in the understanding that the operating ranges cover the entire spectrum of vibrations produced by the mill (60) during operation.

7. The system according to claim 6, wherein the first processor (13) collects the information from the accelerometers (14) for a number of turns preset and processes this information covering the entire circumference of the mantle of the mill (60) and sends all values during the interval of time available for each sensor of vibrations (10, 10'); the values obtained allow determining the shoulder (66) and foot (65) of the volume of load in the control server (50).

8. The system according to claim 7, wherein the data obtained by the accelerometers (14) that are processed by the first processor (13), together with those of sound obtained by microphones (11), and the synchronism signal for a predetermined amount of turns, allows the first processor (13) determining the direction of rotation, the quadrant where the foot (65) should be located and the quadrant where the shoulder (66) should be located; with sound intensity it is verified that the quadrants are the right ones; then, the average of amplitude and variance of vibrations are calculated for the entire circumference of the mill and for each turn; then an average between turns is obtained, getting an average and a variance of a turn that represents them all, and the calculations are sent within the transmission time defined before, the results obtained along with the possible quadrants for foot (65) and shoulder (66).

9. The system according to claim 1, wherein the preceding claims allow and also contribute to reduce the variability and variance in the control of processes of milling and concentrating plants that use said rotary mills.

* * * * *